US010144565B2

(12) United States Patent
Lehecka

(10) Patent No.: US 10,144,565 B2
(45) Date of Patent: Dec. 4, 2018

(54) STORAGE APPARATUS AND RELATED DISCIPLINE METHODS

(71) Applicant: Paul Lehecka, Philpot, KY (US)

(72) Inventor: Paul Lehecka, Philpot, KY (US)

( * ) Notice: Subject to any disclaimer, the term of this patent is extended or adjusted under 35 U.S.C. 154(b) by 0 days.

(21) Appl. No.: 15/458,966

(22) Filed: Mar. 14, 2017

(65) Prior Publication Data

US 2017/0263145 A1 Sep. 14, 2017

Related U.S. Application Data

(60) Provisional application No. 62/307,765, filed on Mar. 14, 2016.

(51) Int. Cl.

| | |
|---|---|
| ***B65D 85/00*** | (2006.01) |
| ***B65D 55/14*** | (2006.01) |
| ***B65D 25/20*** | (2006.01) |
| ***B65D 25/54*** | (2006.01) |
| ***B65D 43/16*** | (2006.01) |
| ***E05G 1/00*** | (2006.01) |

(52) U.S. Cl.

CPC ..... *B65D 55/14* (2013.01); *B65D 25/205* (2013.01); *B65D 25/54* (2013.01); *B65D 43/165* (2013.01); *E05G 1/005* (2013.01)

(58) Field of Classification Search

CPC ..... G09B 19/00; B65D 11/00; B65D 25/205; B65D 55/14; B65D 25/54; B65D 43/165; E05G 1/005

USPC ..... 206/459.5, 349; 434/81–105, 128

See application file for complete search history.

(56) References Cited

U.S. PATENT DOCUMENTS

| | | | | |
|---|---|---|---|---|
| 5,263,576 A * | 11/1993 | Boreen | B65D 43/20 | 206/455 |
| 6,471,060 B1 * | 10/2002 | Leyshon | A63H 3/50 | 206/472 |
| 7,347,693 B2 * | 3/2008 | Low | G07F 1/06 | 434/236 |
| 8,430,671 B2 * | 4/2013 | Kotler | A63F 3/00 | 434/128 |
| 2001/0034013 A1 * | 10/2001 | Bennett | G09B 1/06 | 434/238 |

* cited by examiner

*Primary Examiner* — Rafael Ortiz
(74) *Attorney, Agent, or Firm* — Valauskas Corder LLC

(57) ABSTRACT

An apparatus and related discipline methods comprising a housing with enclosure for receiving an object. A lock mechanism secures the object within the enclosure of the apparatus. Upon completion of one or more goals as communicated by communication components attached to the apparatus, the object may be retrieved.

11 Claims, 7 Drawing Sheets

10

STORAGE APPARATUS AND RELATED DISCIPLINE METHODS

CROSS REFERENCE TO RELATED PATENTS

This application claims the benefit of U.S. Provisional Patent Application No. 62/307,765 filed Mar. 14, 2016, which is incorporated by reference in its entirety.

FIELD OF THE INVENTION

The present invention relates generally to item storage containers, and in particular, storage containers that may securely hold items to be used for discipline purposes, for example to reward or punish individuals, particularly, children.

BACKGROUND OF THE INVENTION

Children are often a source of joy and frustration in daily lives. One of the biggest causes of frustration comes from merely trying to convince the child to comply with directions given by an authority figure. In many instances, such compliance requires some measure of discipline. However, it is often difficult to utilize the proper amount of discipline for a particular situation. These days, the use of physical force as a form of discipline is frowned upon by society, and may also result in emotional trauma to a child receiving such discipline. Moreover, this type of punishment may also demoralize a child and lower self-esteem. For example, "spanking" may cause the child to fear the individual (usually a parent) dispensing the punishment. Such discipline may also indicate that physical punishment is an acceptable form of conflict resolution, potentially leading a child to further behavioral problems in the future.

While there are many other ways to discipline a child, many of these methods suffer from various drawbacks. For example, one common method is sending a misbehaving child to his or her room. While this type of punishment may allow a child to "cool off" and reflect upon their behavior, the child remains unsupervised for a certain period of time.

Another common method is known as the "time out" method. A child is required to sit in the corner or remain in a designated area for a given period of time without distractions. However, if unattended, the child may leave the designated area before the end of the stipulated time period.

On the other hand, some parents have opted toward a discipline system that rewards positive behavior. While such a system may be effective, all too often, a parent may overlook negative behavior, thereby creating a situation where the child may not associate a misbehavior with a negative result. In other situations, ignoring misbehavior while rewarding good behavior may indicate, to a child, that the misbehavior is tolerable.

Accordingly, what is needed is an apparatus and methods that may be used to discipline individuals by securing an object that is of value to the individual until the individual accomplishes a set goal. The current invention addresses this need.

SUMMARY OF THE INVENTION

The presently disclosed invention is directed to an apparatus and related discipline methods for disciplining an individual, and may further discourage negative behavior and/or encourage positive behavior. For example, a child may display certain types of behavior that are deemed "bad" or negative behavior. Such behavior may include not listening or not doing what the child is told by an authority figure, not cleaning up toys or other items, failure to reach a set goal, failure to accomplish chores (e.g. mowing the lawn, washing dishes, washing clothes, etc.), fighting, yelling, or any other behavior that may be considered bad behavior. When such behavior is observed, an authority figure may confiscate an object the child is fond of or adores. The object may be securely contained and may only be retrieved when the child achieves a goal such as completion of a set of tasks or exemplifying certain positive behavior.

In other situations, it may be desirable to reinforce positive behavior. For example, a reward object may be secured in the apparatus and the child may only receive the object after certain goals are accomplished.

Embodiments of an apparatus of the invention may generally comprise a top portion, a body portion, and a bottom portion. The body portion may include a plurality of wall elements and one or more corner support elements forming an enclosure. The wall elements of the body portion may be constructed to form an enclosure of any shape or size, i.e., spherical, conical, pyramidal, or cubical.

The top portion may be operably attached or separate from the body portion to provide both an open configuration allowing access to contents of an enclosure of the apparatus, and a closed configuration without access to the contents. In certain embodiments, the top portion is hingedly attached to the body portion. The apparatus may also include a lock mechanism to secure the top portion with the body portion when the mechanism is activated. In some embodiments, the mechanism may be a lock including, for example, a digital lock, combination lock, or lock with key.

The apparatus may be constructed of any contemplated material, for example, metal, wood, glass, or a clear or transparent material such as plastic. Preferably, all or portions of the apparatus are constructed of a clear material so that the object secured within the enclosure may be viewed in an attempt to motivate the individual while reminding him or her of the set goal. The clear material may include, for example, polyacrylate such as poly (methyl methacrylate), methyl methacrylate, or a combination thereof, plexiglass material, polycarbonate, or glass.

An apparatus may further include a receiving component used to attach a communication component. The receiving component may be disposed on at least a portion of the apparatus and may include a tab, hook, peg, or Velcro®.

The communication component includes indicia on one or both surfaces or faces of the component. The indicia may indicate the goal that must be accomplished before the item within the apparatus may be accessed. The communication component may include goals such as tasks to be completed, for example, "dishes", "mow the lawn", "laundry", or "pick up toys" of behaviors to be exemplified, such as "no whining", "no tantrums", or saying "please" or "thank you". According to one embodiment, the communication component may be reversible by containing indicia on both sides—one side communicating the goal to be accomplished and the other side indicating the goal has been completed (e.g. a check mark). It is contemplated that the communication component may also be a digital display either separate or integrated with the apparatus.

The apparatus according to the invention may also include a bottom portion comprising a storage element, such as a tray or drawer that may store the communication components when not in use.

The present invention and its attributes and advantages will be further understood and appreciated with reference to the detailed description below of presently contemplated embodiments, taken in conjunction with the accompanying drawings.

BRIEF DESCRIPTION OF THE DRAWINGS

The preferred embodiments of the invention will be described in conjunction with the appended drawings provided to illustrate and not to the limit the invention, where like designations denote like elements, and in which.

DETAILED DESCRIPTION OF EMBODIMENTS OF THE INVENTION

Generally, embodiments of an apparatus of the invention are configured to contain certain objects, preferably objects, which an individual such as a child, attaches value, e.g., sentimental, entertainment, monetary. In order to retrieve the object, the individual must complete one or more goals identified by communication components associated with the apparatus. The communication components may be positioned on any surface of the apparatus. In certain embodiments of the invention, the apparatus is constructed of a clear, or transparent, material so that the object is "plain view".

Figure 1:
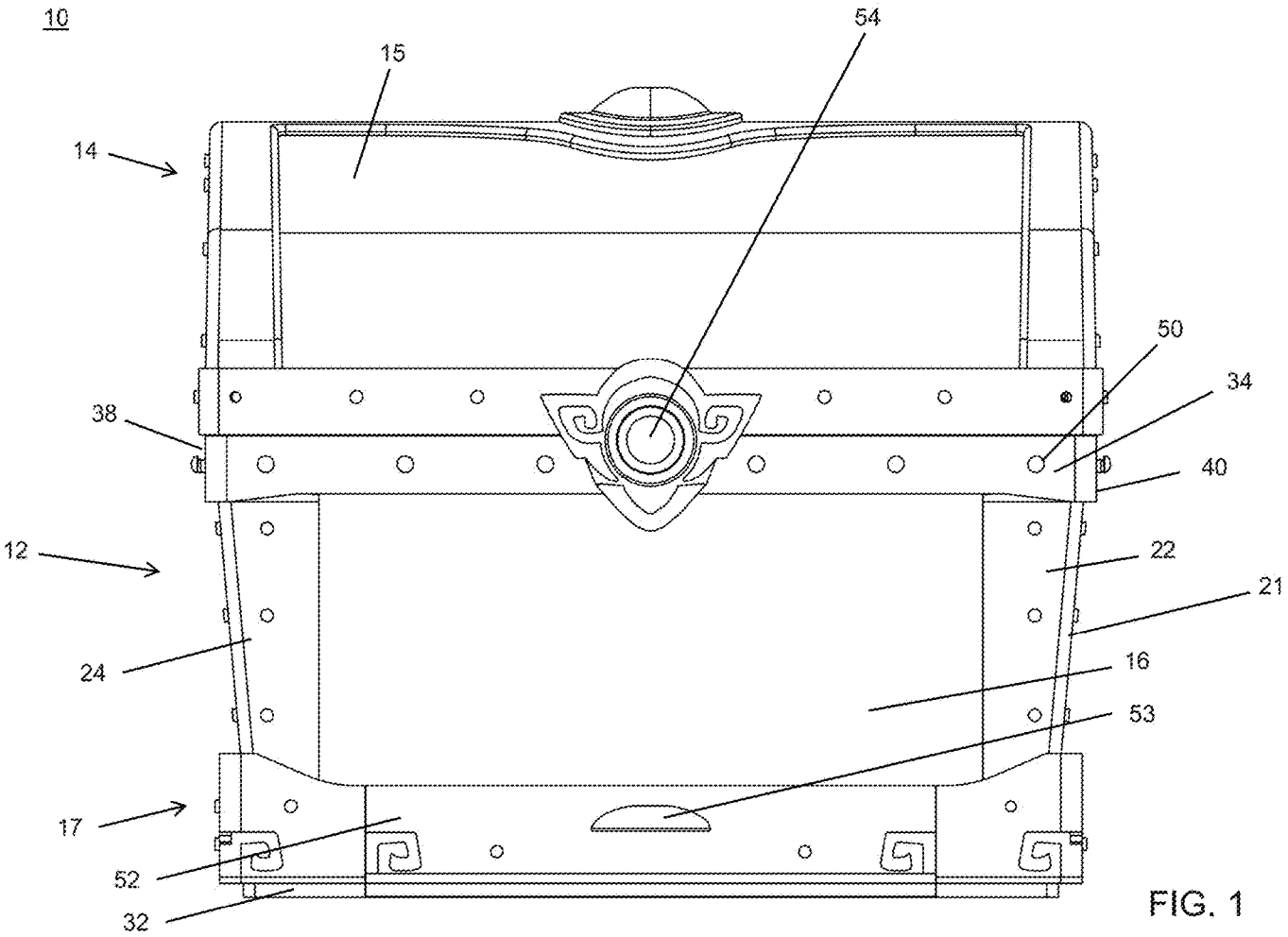
FIG. 1 illustrates a front view of an apparatus according to one embodiment of the invention.
Figure 2:
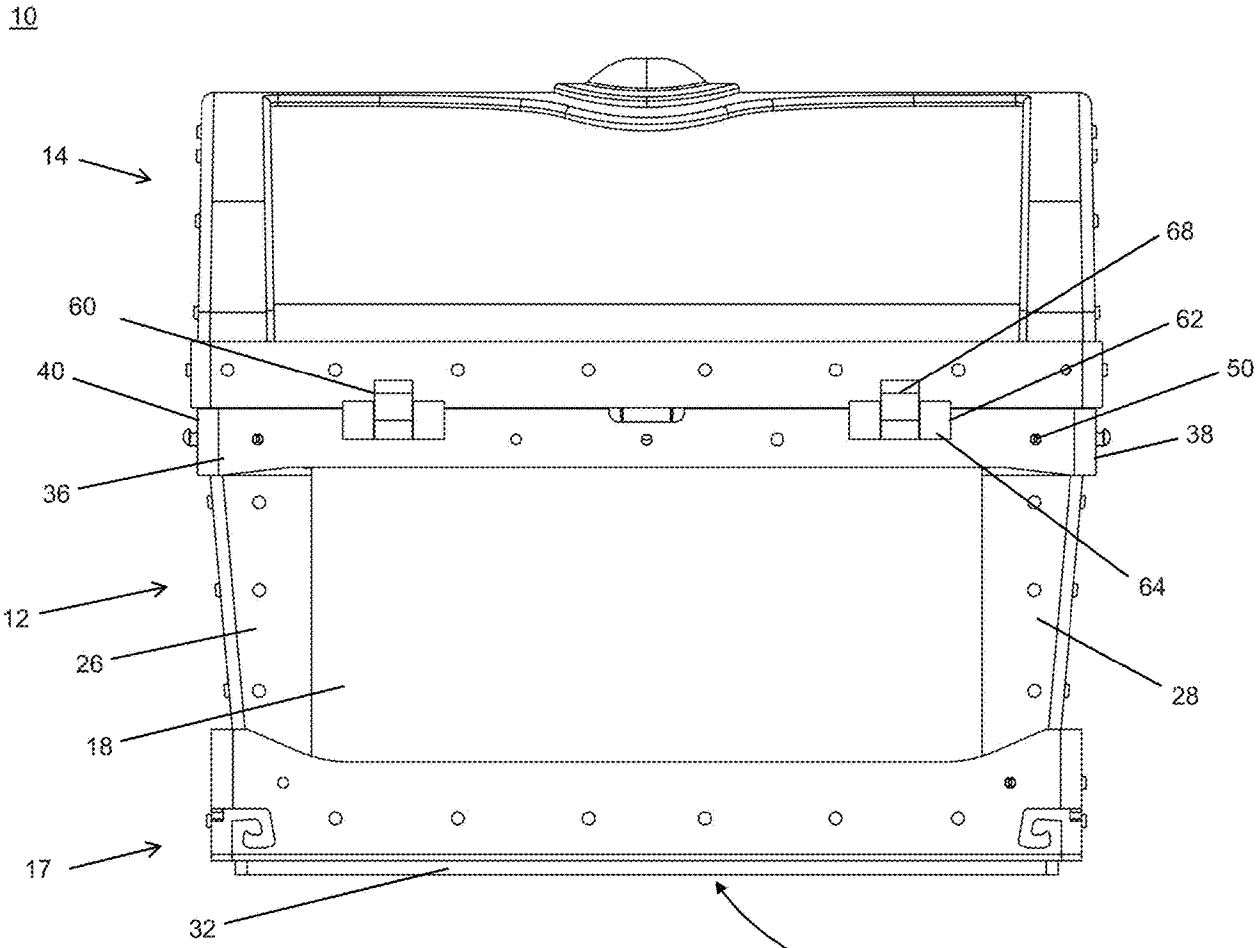
FIG. 2 illustrates a rear view of the apparatus.
Figure 3:
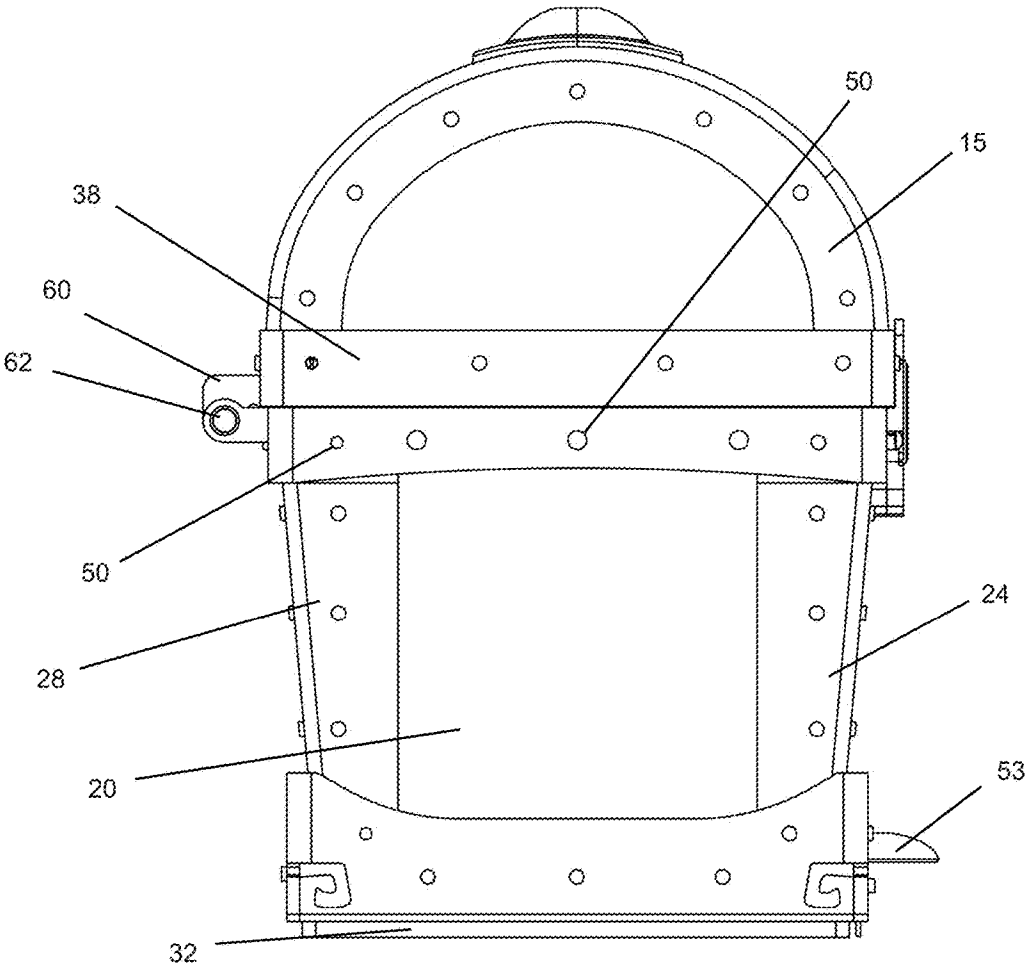
FIG. 3 illustrates a side view of the apparatus.

FIGS. 1, 2, and 3 illustrate an embodiment of an apparatus according to the invention. The exemplary apparatus comprises a housing 10, which includes a body portion 12, a top portion 14, and a bottom portion 17. In one embodiment, the body portion 12 may include an enclosure 19 formed from a plurality of wall elements—a 16, 18, 20, 21, 30. The body portion 12 may comprise three or more wall constructing an enclosure in any contemplated form, for example, a cube, sphere, cone, pyramid, or polygon. In certain embodiments, two or more walls may be secured together via corner support elements 22, 24, 26, 28, however in alternate embodiments, the walls may be directly attached to each other, or a combination thereof. One of the walls 30 may form both the body portion 12 and the bottom portion 17.

The body portion 12 may further comprise a facing that surrounds the top perimeter of the body portion 12, although it is contemplated that a facing may surround the bottom perimeter of the body portion 12. The facing may comprise front top facing element 34, a rear top facing element 36, and two top side facings elements 38, 40.

A plurality of receiving components 50 may be disposed on one or more of the facing elements 34, 36, 38, 40. In some embodiments, the plurality of receiving components 50 may comprise one or more tabs, hooks, pegs, magnets, Velcro® or a combination thereof. Each receiving component 50 is configured to position a communication component 69 to the apparatus as described in more detail below. Preferably, the plurality of receiving components 50 are disposed about a least a portion of the top front facing element 34 and may further be disposed about side facing elements 38, 40. When attached, each communication component 69 is predominantly displayed. In other embodiments, the receiving components may protrude directly from a surface of the wall elements 16, 18, 20, 21, 30, or may be integrated with one or more support elements 22, 24, 26, 28.

The top portion 14 includes a lid element 15 that covers the body portion 12, specifically enclosure 19, in a closed configuration. In an open configuration, lid element 15 uncovers the body portion 12 for access to the enclosure 19.

In certain embodiments, the bottom portion 17 includes a storage element 52, such as a tray or drawer, which may be disposed between a wall 30 of the body portion 12 and a base element 32. The storage element 52 slideably engages with the bottom portion 17, but may engage with the body portion 12, or both. The storage element 52 is sized and shaped to hold communication components 69 or other items such as a key for the lock mechanism 54. The storage element 52 may further include a gripping element 53, such as a handle or knob, to facilitate operation of the storage element 52.

The body portion 12 may also comprise a lock mechanism 54 for securing the item within the enclosure of the apparatus. The mechanism 54 may include any type of lock, such as a digital lock, a combination lock, a lock with key, as well as locks using software application to remotely activate or deactivate the lock mechanism 54. In a preferred embodiment of the invention, the mechanism 54 is a lock with key. The lock mechanism 54 may be at least partially disposed on or in a wall element 16, 18, 20, 21, 30 of the body portion 12 and secures the top portion 14 to the body portion 12 when the apparatus is in a closed configuration.

It is also contemplated that the apparatus operates in conjunction with a software application such as one accessible through the Internet via computer or mobile device. As described above, the software application may be used with the lock mechanism 54 to remotely activate or deactivate the lock mechanism. The software application may also be used with sensors to remotely monitor the apparatus, i.e., whether or not the enclosure was accessed and the item removed, or whether or not the goals have been accomplished.

The housing 10 may be constructed of any known material including plastic, steel, glass, wood, or any combination. The material may also be a polymeric or thermoplastic material easily manufactured by a process such as injection molding. In certain embodiments, some or all of the housing 10 may be constructed of a clear material so that the object within the enclosure 19 is in "plain sight". Such clear material may include, for example, polyacrylate such as poly (methyl methacrylate), methyl methacrylate, or a combination thereof—also known as acrylic or acrylic glass—plexiglass material, polycarbonate or glass.

The various parts of the body portion 12, top portion 14 and bottom portion 17 may be connected via any conventional attachments means such as through the use of screws, nails, bolts, pegs, snap tabs, welding, molding or adhesives. In a preferred embodiment, attachment of various parts of the apparatus may be achieved through snap tabs where a certain part of the apparatus may have a male snap tab and an attaching piece of the apparatus may be shaped to receive the male snap tab.

Figure 4:
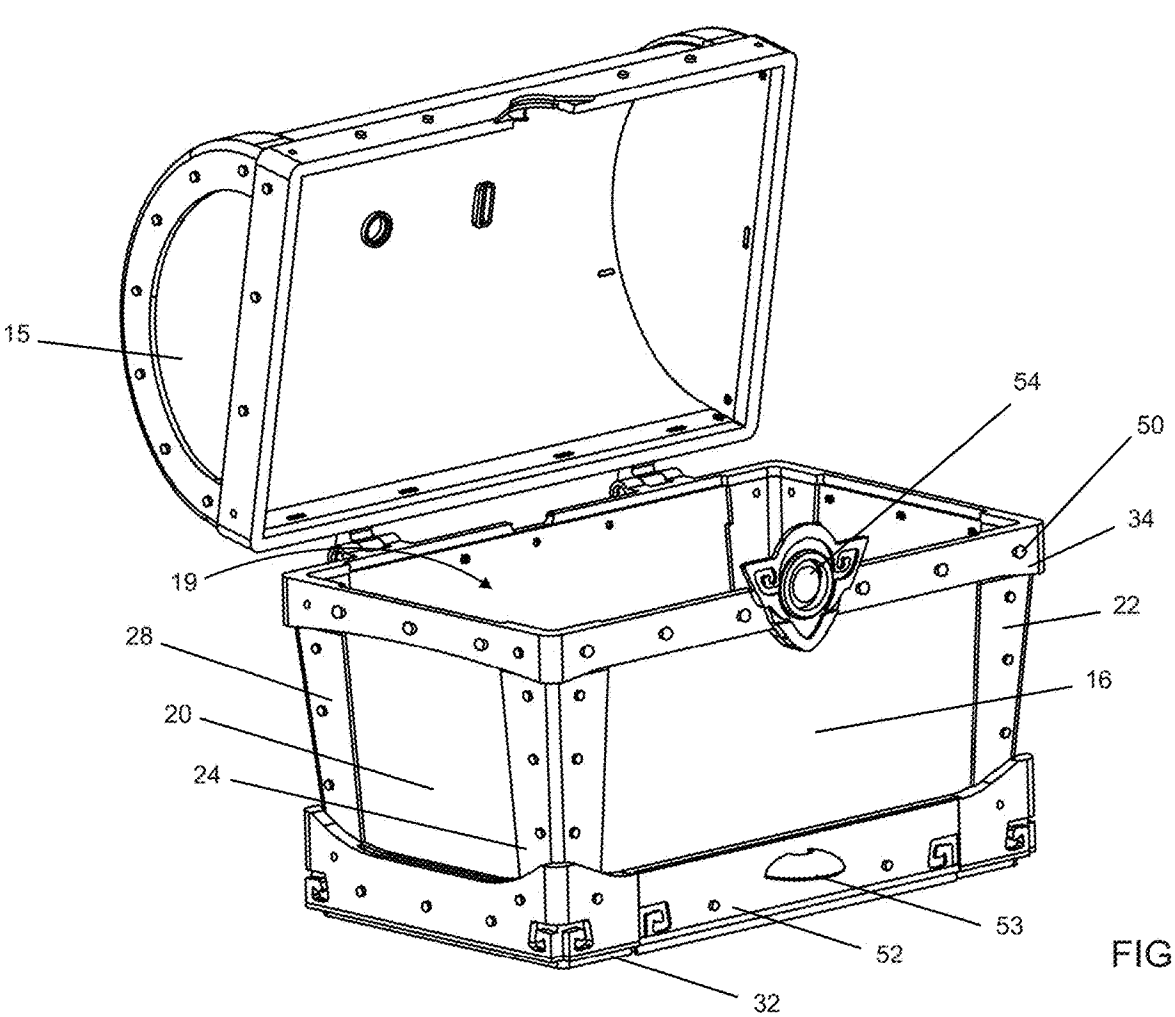
FIG. 4 illustrates the apparatus in an open configuration.

As illustrated in FIG. 2, the housing 10 further includes a hinge mechanism 60 to open and close the top portion 14, however in certain embodiments, the top portion 14 is completely separable from the body portion 12. The hinge mechanism 60 may be constructed of the same material, or different material than the housing 10. In a preferred embodiment, the hinge mechanism is constructed of a plastic material. Moreover, a first element 64 of the hinge mechanism and a second element 68 of the hinge mechanism may be integrally molded into the body portion 12 and top portion 14, respectively. A pin or insert element 62 may be used to connect the first element 64 and the second element 68 of the hinge mechanism 60. The hinge mechanism 60 moves the top portion 14 including lid element 15 with respect to the body portion 12, to achieve either an open configuration allowing access to the enclosure 19 or a closed configuration. An embodiment of the invention is illustrated in FIG. 4 in which the apparatus is in an open configuration.

Figure 5:
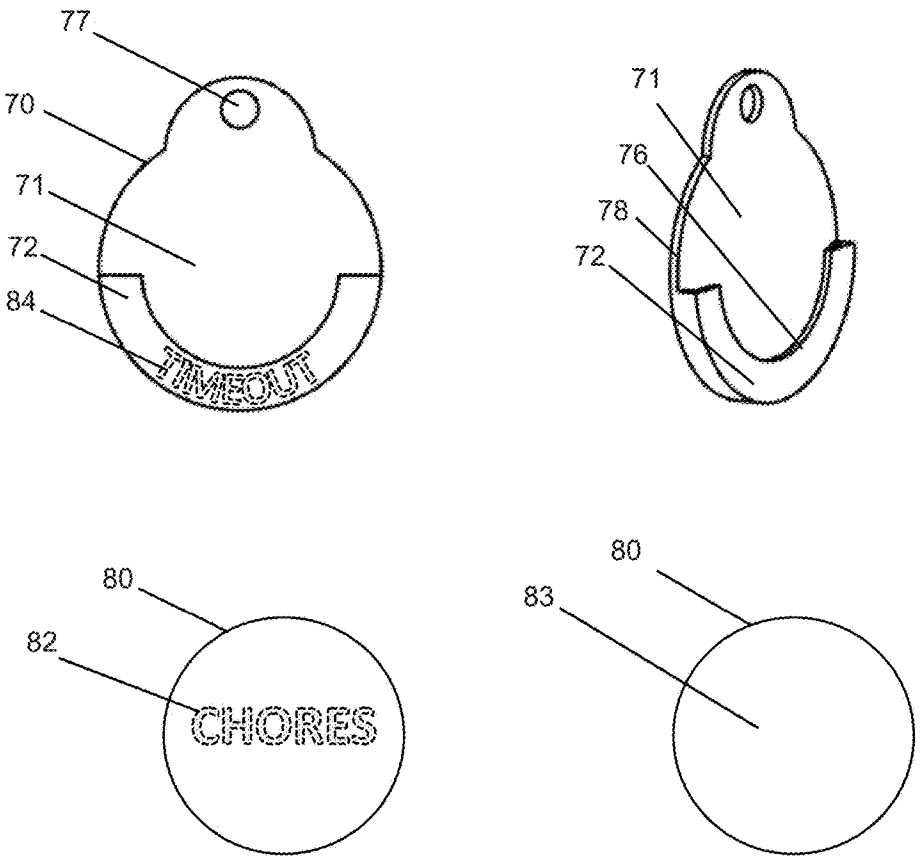
FIG. 5 illustrates elements of a communication component according to one embodiment of the invention.
Figure 6:
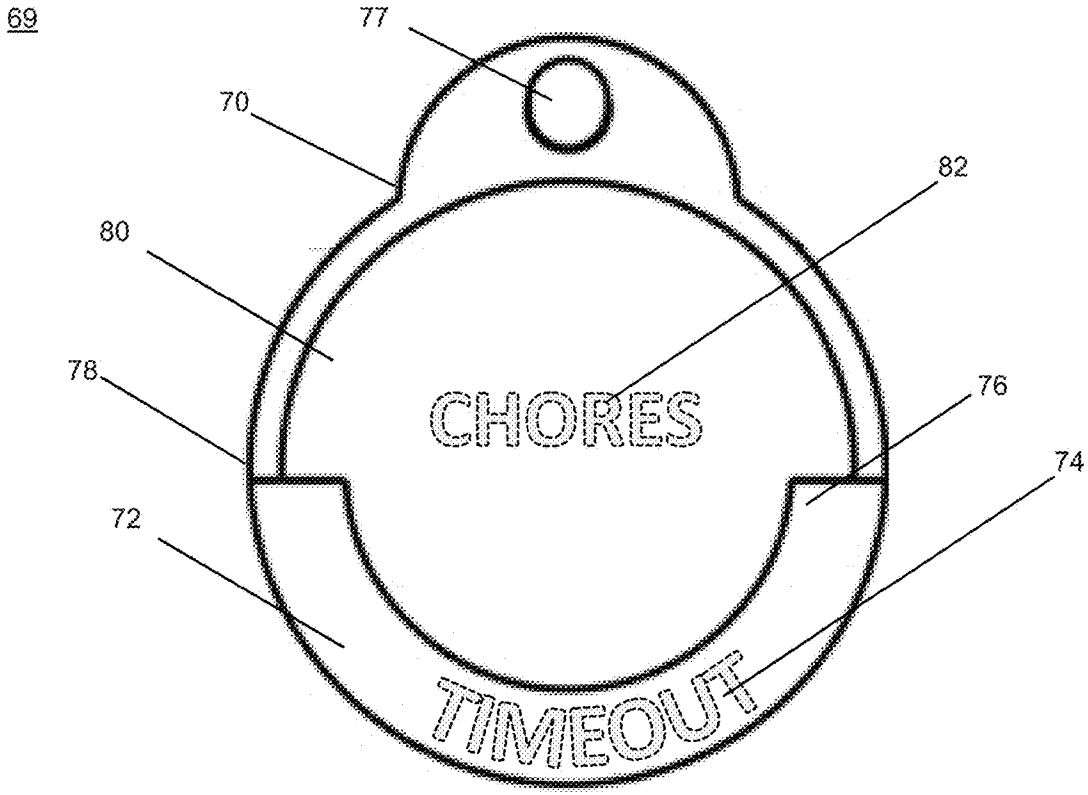
FIG. 6 illustrates the elements of the communication component as assembled.

FIG. 5 illustrates elements of a communication component 69 and FIG. 6 illustrates the elements of the communication component 69 as assembled. Although the communication component 69 is shown as generally circular, any shape is contemplated such as diamond, square or oval. The communication component 69 includes a tag component 80 and a holding component 70. Tag component 80 may be pre-printed with content or indicia 82, or left blank 83. It is also contemplated that holding component 70 may include indicia 84.

The tag component 80, as shown, includes indicia that indicate certain goals to be completed in order to retrieve an object locked in the enclosure. The tag component include such goals as "homework", "dishes" or "pick up toys" etc. on one side. On the reverse side, a tag component may have indicia indicating the goal has been completed such as "finished" or "completed" or another mark such as a check mark. Other indicia may include, for example, "empty garbage", "make bed", "water plants", "brush teeth", "dishes", "laundry", "dust", "pick up toys", "sweep or vacuum", "homework", "take a bath", "clean room", etc.

Blank tag component 83 may be either used with labels or a writing utensil such as a marking pen to add custom goals. In embodiments in which labels are used with the communication tags, the labels may be of a standard "off the shelf" size and shape including square, rectangular, and circular. The labels may be used with a printing device that prints custom content (i.e. text, figures, pictures, etc.) on the labels. For example, a software application may be provided for users to create custom chores printable on standard size labels.

The holding component 70 may be sized and shaped to accommodate and retain a tag component 80, while also allowing a user to easily position and remove a tag component 80 from within the holding component 70. In particular, holding component 70 may have a pocket element 76 along all or a portion of a perimeter edge 78 to retain or hold the tag component 80. The pocket element 76 is formed between a surface 71 of the holding component 70 and a wall 72 spaced at a distance from the surface 71.

The holding component 70 may also comprise an attachment element 77. The attachment element 77 may include an opening that is sized and shaped to attach to the receiving component 50 or may be of a material substance such as Velcro® or tape. It is also contemplated that the holding component 70 and/or tag component 80 may include a magnetic element for positioning on a magnetic surface of the apparatus. Preferably, the holding component 70 may be placed on a receiving component 50 positioned on the exterior of the housing 10 as described above. In other embodiments, the holding component and tag component may also be placed on the object stored in the enclosure 19.

In certain embodiments, each surface of the tag component 80 may a different color. For example, one side of the tag component may be red to communicate a chore is incomplete and the opposing side of the tag may be green to communicate the chore is completed. Alternatively, the opposing side of the tag component may have different indicia indicating the goal is complete, such as a check mark. In other embodiments, the tag components may be available in a variety of colors such as to color coordinate between several children, e.g., Max is blue and Grace is pink.

Communication component 69 may be made of any material and be of any size and shape. For example, the tag component and holding component may each be wood, plastic, fabric, or composed of a material known as "dry-erase" so that content can be easily written and removed using a dry-erase marking pen.

Figure 7:
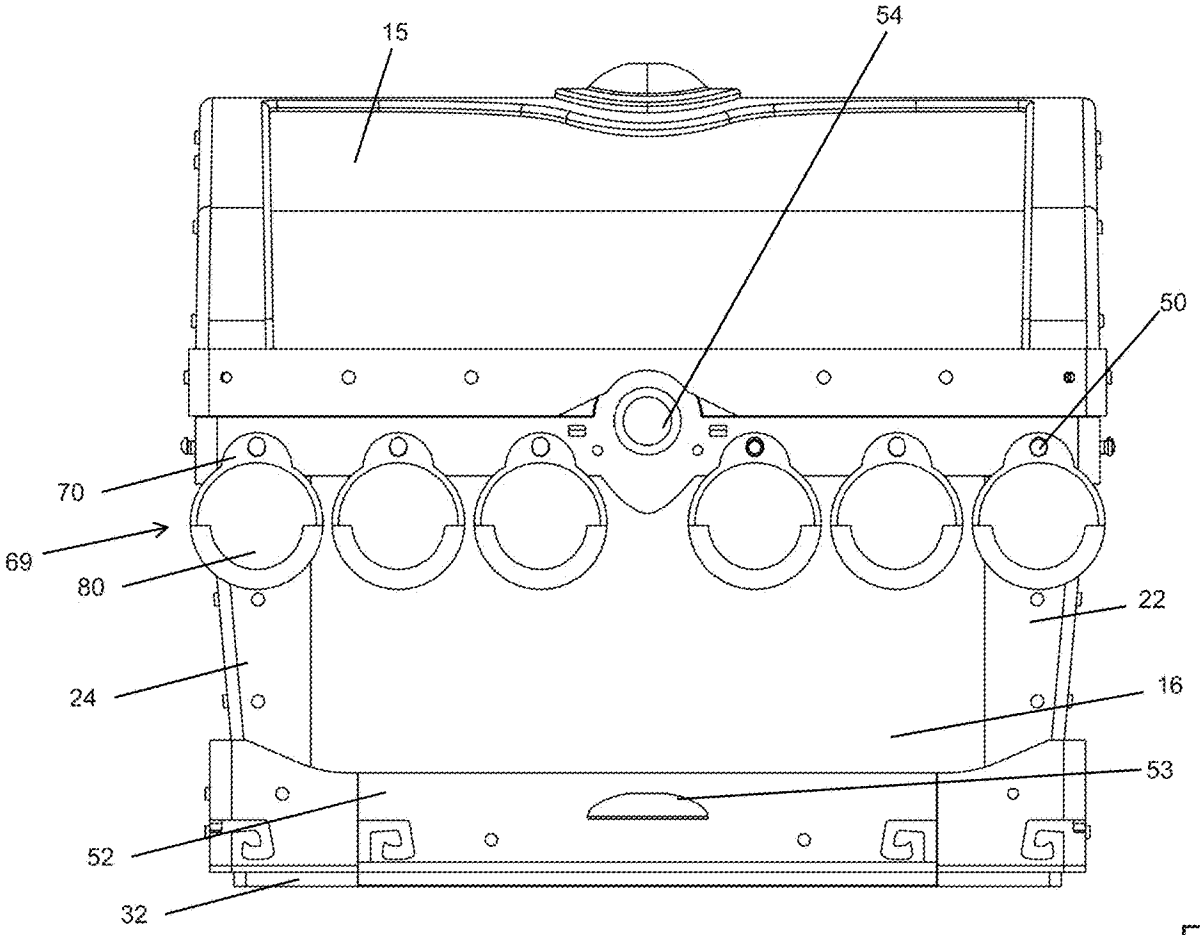
FIG. 7 illustrates one of many contemplated embodiments of the invention.

FIG. 7 illustrates a preferred embodiment of the invention with various objects securely locked within the enclosure. With the walls constructed of a clear material, the enclosed contents are visible. Upon completion of one or more goals as communicated by communication components attached to the apparatus, the object may be retrieved.

The invention may be used to promote positive behavior. Communication components may be used to indicate goals to be accomplished in order for a child to be rewarded with the object within the enclosure, for example, a monetary sum, a new phone or toy, concert tickets, plane tickets, food or candy, or any other gift. The invention may be also used to punish negative behavior. Communication components may be used to indicate tasks to be completed before a child is given the object that was taken away and placed in the enclosure.

In particular, an object is placed and secured in the enclosure of the apparatus where the child may see the object, but not touch or play with it. A communication component is created or chosen by placing a tag component with the selected indicia within the holding component. The holding component is attached to the apparatus using the receiving components. Both the display of the goals to be accomplished as well as the visual reminder of the object locked in the enclosure may convince the child to accomplish the indicated goal. Once the goals are accomplished, the tag component may be reversed to indicate completion of the goal and the object returned to the child.

Although the invention was described as used with discipline methods, other purposes are contemplated. For example, the invention may be used in a group setting such as in the classroom. A certain goal is set, such as an academic goal for the entire class, and a reward (such as representations of a field trip, or extra recess time) is secured in the enclosure. The appropriate communication components are used to remind and encourage the class to accomplish the goal. Once the certain goals are reached, the reward may be given to the students. Alternatively, the invention may be used in conjunction with raffles, auctions, or fundraising. For example, a prize or reward (e.g. cash, or sports tickets etc.) may be secured in the enclosure of the apparatus and a certain number of "attempts" to access the secured container may be sold. "Attempts" may be keys, passwords, combinations, or the like depending on the type of lock mechanism. More specifically, if the storage container contains a lock with key mechanism, a number of the keys (e.g. 10, 50 or 100 etc.) may be purchased for a certain price. One or more keys may open the secured container. After a certain number of keys are sold, or certain amount of cash raised, the purchasers attempt to open the secured container and, if successful, win the prize.

While the disclosure is susceptible to various modifications and alternative forms, specific exemplary embodiments of the present invention have been shown by way of example in the drawings and have been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

The invention claimed is:

1. A storage apparatus, comprising:

a housing including an enclosure formed by a body portion, a top portion, and a bottom portion, the body portion including four transparent vertical wall elements, four corner support elements, and a horizontal bottom wall element, each corner support element connecting two transparent vertical walls elements, the four transparent vertical wall elements and the four corner support elements connected to the horizontal bottom wall element, the top portion including a lid element covering the enclosure in a closed configuration and the lid element providing access to the enclosure in an open configuration, the bottom portion including a base element and a moveable drawer storage element located between the base element and the horizontal bottom wall element of the body portion, a facing positioned on a top perimeter of the four vertical wall elements of the body portion, the facing including a front top facing element, a rear top facing element, and two top side facing elements;

one or more hook receiving components each positioned on the front top facing element;

a lock mechanism positioned on the front top facing element, the lock mechanism securing the lid element covering the enclosure in the closed configuration;

one or more communication components each comprising a circular tag component and a circular holding component, the circular holding component including an opening sized and shaped for attachment to the one or more hook receiving components and a pocket element located along all or a portion of a perimeter edge of the circular holding component, the circular tag component removably positioned within the pocket element.

2. The storage apparatus of claim 1, wherein the hook receiving components are positioned on one or both top side facing elements.

3. The storage apparatus of claim 1 further comprising a sensor configured to monitor whether or not the enclosure was accessed.

4. The storage apparatus of claim 1 further comprising a hinge mechanism connecting the top potion and the body portion.

5. The storage apparatus of claim 1, wherein the drawer storage element includes a handle gripping element.

6. The storage apparatus of claim 1, wherein the lock mechanism is a lock with a key.

7. The storage apparatus of claim 1, wherein the four transparent vertical wall elements are made from a material selected from a group consisting of polyacrylate, plexiglass, polycarbonate, and glass.

8. The storage apparatus of claim 1, wherein the tag component includes a first surface and an opposing second surface and both surfaces include indicia.

9. The storage apparatus of claim 8, wherein the indicia is a check mark.

10. A storage apparatus, comprising a housing including an enclosure formed by a body portion, a top portion, and a bottom portion, the body portion including four transparent vertical wall elements, four corner support elements, and a horizontal bottom wall element, each corner support element connecting two transparent vertical walls elements, the four transparent vertical wall elements and the four corner support elements connected to the horizontal bottom wall element, the top portion including a lid element covering the enclosure in a closed configuration and the lid element providing access to the enclosure in an open configuration, the bottom portion including a base element and a moveable drawer storage element located between the base element and the horizontal bottom wall element of the body portion, a facing positioned on a top perimeter of the four vertical wall elements of the body portion, the facing including a front top facing element, a rear top facing element, and two top side facing elements;

one or more hook receiving components each positioned on the front top facing element;

a lock mechanism positioned on the front top facing element, the lock mechanism securing the lid element covering the enclosure in the closed configuration;

one or more communication components each comprising a tag component and a holding component, the holding component including an opening and a pocket element, the opening sized and shaped to attach the holding component to the one or more hook receiving components, and the pocket element formed between a surface of the holding component and a wall spaced at a distance from the surface of the holding component, the tag component including a first surface and an opposing second surface, wherein both surfaces of the tag component include indicia.

11. The storage apparatus of claim 10, wherein the four transparent vertical wall elements are made from a material selected from a group consisting of polyacrylate, plexiglass, polycarbonate, and glass.

* * * * *